US006840335B1

(12) United States Patent
Wu

(10) Patent No.: US 6,840,335 B1
(45) Date of Patent: Jan. 11, 2005

(54) ELECTRIC POWER TOOL

(75) Inventor: Chien-Chun Wu, Taichung Hsien (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 0 days.

(21) Appl. No.: 10/681,115

(22) Filed: Oct. 9, 2003

(30) Foreign Application Priority Data

Aug. 6, 2003 (TW) ..... 92214286 U

(51) Int. Cl.[7] ..... B25F 3/00
(52) U.S. Cl. ..... 173/217; 310/50
(58) Field of Search ..... 173/217, 117, 173/216, 104; 310/47, 50; 429/99

(56) References Cited

U.S. PATENT DOCUMENTS 5,799,739 A 9/1998 Takaada et al.
5,816,121 A * 10/1998 Yoshimizu et al. ..... 81/469
5,881,823 A * 3/1999 Kabatnik et al. ..... 173/217
5,902,080 A 5/1999 Kopras
6,223,835 B1 * 5/2001 Habedank et al. ..... 173/217
6,502,949 B1 * 1/2003 Horiyama et al. ..... 362/119
6,656,626 B1 * 12/2003 Mooty et al. ..... 429/99
6,729,413 B2 * 5/2004 Turner et al. ..... 173/217
6,729,414 B2 * 5/2004 Cooper et al. ..... 173/217
6,729,415 B1 * 5/2004 Huang ..... 173/217

* cited by examiner

*Primary Examiner*—Scott A. Smith
(74) *Attorney, Agent, or Firm*—Birch, Stewart, Kolasch & Birch, LLP

(57) ABSTRACT

An electric power tool includes a tool unit and a battery pack. The tool unit includes a pair of conjunct grooves and two corresponding blocks. The battery pack includes a pair of conjunct rails and two locking members. The tool unit and the battery pack are connected and locked with each other respectively by that the conjunct grooves and the conjunct rails are interconnected with each other and the two locking members and the two blocks are jammed together. In addition, the tool unit and the battery pack can be dimensionally reduced and the cohesive effect therebetween can be strengthened respectively by the conjunct grooves and the conjunct rails.

6 Claims, 3 Drawing Sheets

ELECTRIC POWER TOOL

This nonprovsional application claims priority under 35 U.S.C. § 119(a) on Patent Application No(s). 92214286 filed in TAIWAN on Aug. 6, 2003, which is(are) herein incorporated by reference.

BACKGROUND OF THE INVENTION

1. Field of the Invention

The present invention relates generally to electric power tools, and more particularly, to a direct-current electric power tool.

2. Description of the Related Art

The power source of a general electric power tool can be alternate current and direct current provided by a battery pack, wherein the latter is more popular than the former with common amateur users.

A commercially available direct-current power tool, such as U.S. Pat. Nos. 5,799,739 and 5,902,080, is primarily composed of a tool unit and a battery pack. The tool unit includes a coupling receptacle having a receiving chamber formed therein, an opening in communication with the receiving chamber, and an electrical contact disposed inside the chamber. The battery pack includes a connector protruded outwards and an electrical output contact. The connector of the battery pack is inserted into the chamber to enable the electrical output contact to electrically connect the electrical contact and to enable the battery pack to connect the tool unit.

The battery pack further includes a locking device having a button and a pawl. When the battery pack is connected with the coupling receptacle, the pawl engages with a block positioned on an inner periphery corresponding to the pawl to secure the battery pack to the tool unit from disengagement. When the user intends to remove the battery pack from the tool unit, it is easy to remove the battery pack from the tool unit by pressing the button to enable the pawl to disengage from the block.

The aforementioned connector and receiving chamber must have enough length and deepness to enlarge the contact area between the connector and the chamber to further enhance the cohesiveness between the battery pack and tool unit, thereby preventing the battery pack from shake which causes imperfect contact between the electrical output contact of the battery pack and the electrical contact of the tool unit. Hence, the battery pack and the tool unit will structurally and dimensionally enlarged to cause inconvenience for carrying the electric power tool.

Additionally, when the battery pack is connected with the tool unit, the pawl is directly burdened with the whole weight of the battery pack to easily damage the pawl or the block while the battery pack is slightly impacted to further cause the battery pack to disengage from the tool unit; this aforementioned drawback can be found in U.S. Pat. No. 5,799,739. Further, because the battery pack is controlled to disengage from the tool unit by one single button, it is easy to cause the user to carelessly touch the button to further cause the battery pack to disengage from the tool unit while operating the power tool.

SUMMARY OF THE INVENTION

The primary objective of the present invention is to provide an electric power tool, in which a battery pack thereof and a tool unit thereof are preferably tight connected with each other.

The secondary objective of the present invention is to provide an electric power tool, in which the size of a battery pack thereof and a tool unit thereof are effectively reduced.

The foregoing objectives of the present invention are attained by the electric power tool, which is composed of a tool unit and a battery pack. The tool unit includes a pair of conjunct grooves and two corresponding blocks. The battery pack includes a pair of conjunct rails and two locking members. The tool unit and the battery pack are connected and locked with each other respectively by that the conjunct grooves and the conjunct rails are interconnected with each other and the two locking members and the two blocks are jammed together. In addition, the tool unit and the battery pack can be dimensionally reduced and the cohesive effect therebetween can be strengthened respectively by the conjunct grooves and the conjunct rails.

DETAILED DESCRIPTION OF THE INVENTION

Figure 1:
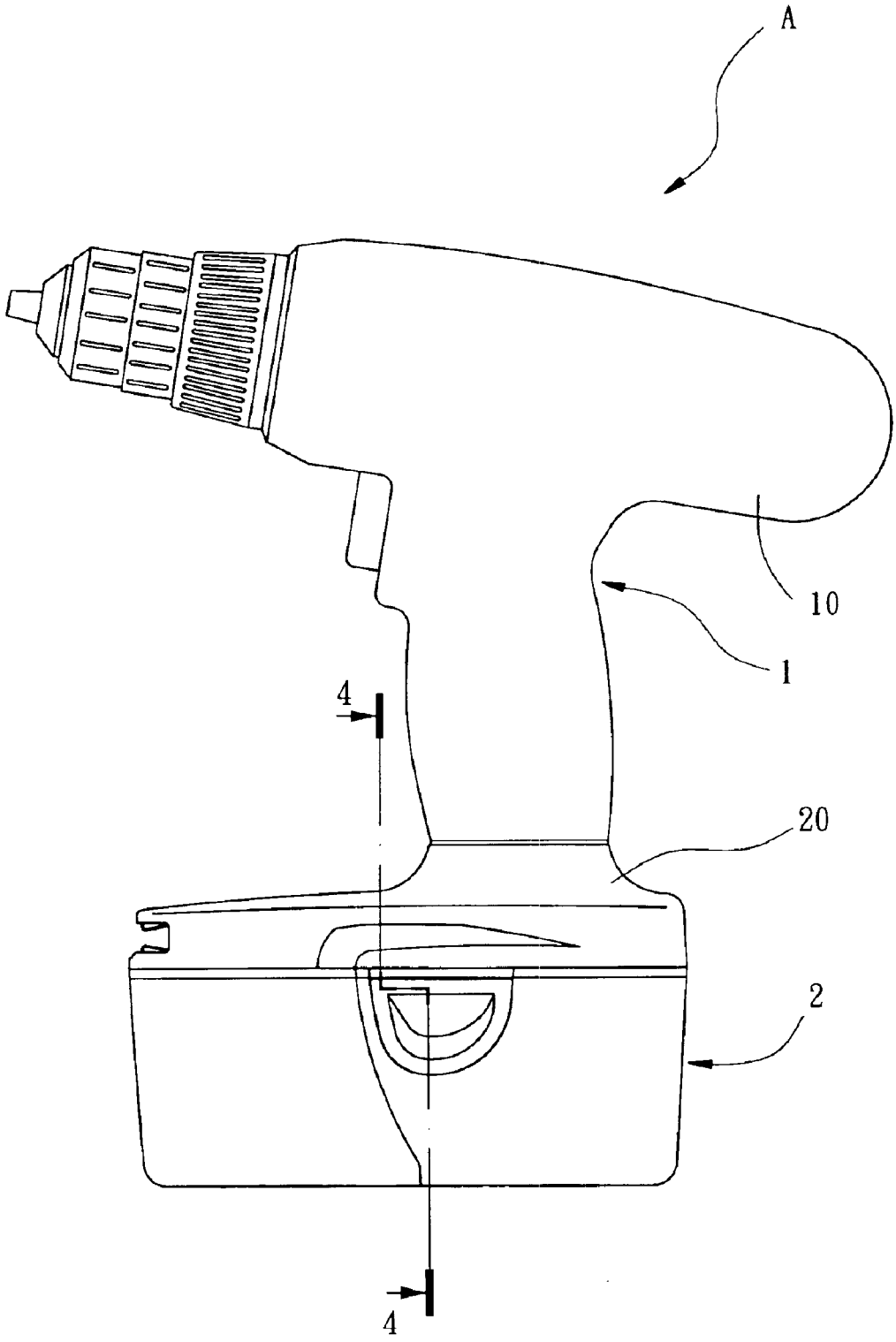
FIG. 1 is a schematic view of a preferred embodiment of the present invention.
Figure 2:
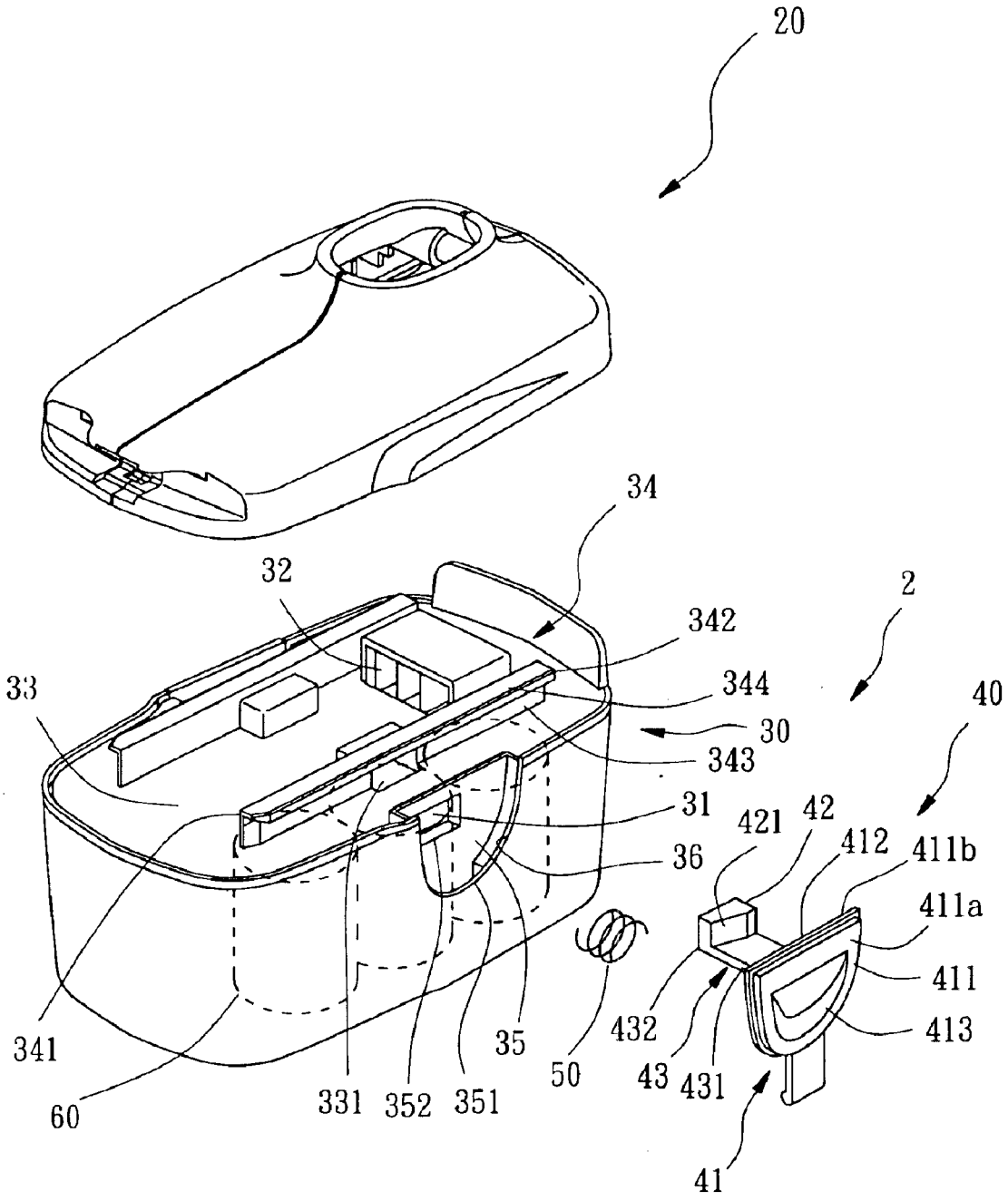
FIG. 2 is a partial exploded view of the preferred embodiment of the present invention.
Figure 3:
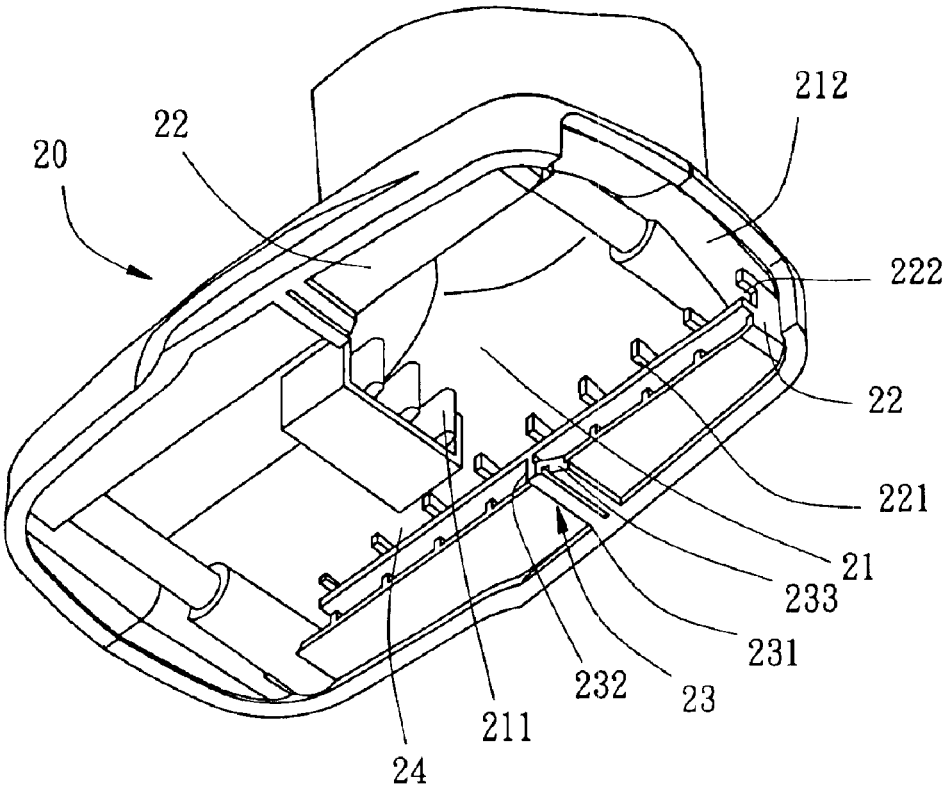
FIG. 3 is a perspective view of a coupling member of the preferred embodiment of the present invention viewing from the bottom side thereof.

Referring to FIGS. 1–3, an electric power tool A constructed according to a preferred embodiment of the present invention is composed of a tool unit 1 and a battery pack 2.

The tool unit 1 includes a tool body 10 and a coupling member 20 connected to a bottom side of the tool body 10, wherein the tool body 10 is well known to the one who is skilled in the art, such that no more description of the tool body 10 is required. A receiving chamber 21 is formed inside the coupling member 20 and defines a bottom opening 211 and a lateral opening 212 respectively at a bottom side and a lateral side of the coupling member 20, wherein the bottom opening 211 and the lateral opening 212 communicate with each other. The coupling member 20 has a pair of parallel skeleton-like members 22 positioned at bilateral sides of the chamber 21 and extending respectively from an end thereof in proximity of the lateral opening 212 towards the other end thereof. Each of the two skeleton-like members 22 has a conjunct groove 221 extending from the one end thereof in proximity of the lateral opening 212 towards the other end thereof. The two conjunct grooves 221 respectively define two openings facing to each other and two insertion holes 222 formed at two ends thereof in proximity of the lateral opening 212. The coupling member 20 further has two curbs 23 positioned respectively at two bottom sides of the two skeleton-like members 22. Each of the two curbs 23 defines a root end 231 and a free end 232 at two ends thereof, the two free ends 232 of the two curbs 23 facing to each other, and has a guide surface 233 extending from the free end 232 towards the root end 231 thereof and the insertion hole 222. The coupling member 20 further has electrical contacts 24 positioned inside the chamber 21.

The battery pack 2 includes a housing 30, two locking members 40, two springs 50, and a set of battery cells 60.

The housing 30 has a battery compartment 31 formed inside for receiving and securing the battery cells 60. A power output contact 32 is disposed on the housing 30 at a position thereof corresponding to the electrical contact 24 for electrically connecting electrodes of the battery cells 60. The housing 30 further has a top cover 33 and a pair of conjunct rails 34 formed on the top cover 33 for accommodating the two conjunct grooves 221. The two conjunct rails 34 are parallel to each other and each is provided with a first end 341 and a second end 342, wherein the two first ends 341 are positioned at the same side, and so are the two second ends 342. Each of the conjunct rails 34 has a root portion 343 and a rail portion 344, wherein the two root portions 343 respectively extend vertically upwards from the top cover 33, and the two rail portions 344 extend horizontally respectively towards opposite directions. While the two first ends 341 of the two conjunct rails 34 respectively face towards the two insertion holes 222 of the two conjunct grooves 221, the two rail portions 344 can be respectively inserted through the two insertion holes 222 and into the two conjunct grooves 221 to enable the housing 30 to be connected with coupling members 20. Two slots 331 are formed on the top cover 33 and positioned respectively at two lower sides of the two root portions 343 of the two conjunct rails 34. Two cavities 35 are formed respectively at two lateral symmetrical portions of the housing 30 and have two openings 351 positioned at two lateral sides of the housing 30. Two through holes 352 are formed respectively at bottom sides of the two cavities 35 and communicate with the battery compartment 31. In addition, the housing 30 further has two flanges 36 extending outwards respectively along parts of fringes of the two openings 351.

Each of the two locking members 40 has a button 41, locking portion 42, and an arm portion 43 connecting the button 41 and the locking portion 42. Each of the buttons 41 has a main body 411 and a raised ridge 412. Each of the two main bodies 411 is flat and is provided with an exterior surface 411*a*, an interior surface 411*b*, and a recessed portion 413 formed on the exterior surface 411*a* for a hand's pressing. The two raised ridges 412 respectively correspond to the two flanges 36 of the housing 30 and extend outwards respectively from parts of outer peripheries of the two main bodies 411. Each of the two arm portions 43 is elongated flat and defines a root end 431 and a distal end 432, wherein each of the root ends 431 is connected to the interior surface 411*b* of the main body 411 of the button 41. The locking member 42 is a lug formed at the distal end 432 of the arm portion 43 and has a second guide surface 421 thereon.

While the two locking members 40 are connected to the housing 30, the two buttons 41 are positioned respectively inside the two cavities 35 and each of the two exterior surfaces 411*a* of the two main bodies 41 is exposed outside the opening 351. The two arm portions 43 are inserted respectively through the two through holes 352 and into the battery compartment 31. The two locking members 42 respectively pass through and out of the two slots 331 to be positioned respectively under the two rail portions 344 of the two conjunct rails 34.

The two springs 50 are positioned respectively inside the two cavities 35 and each has two ends contacting respectively against the bottom side of the cavity 35 and the interior surface 411*b* of the main body 411 of the button 41.

Figure 4:
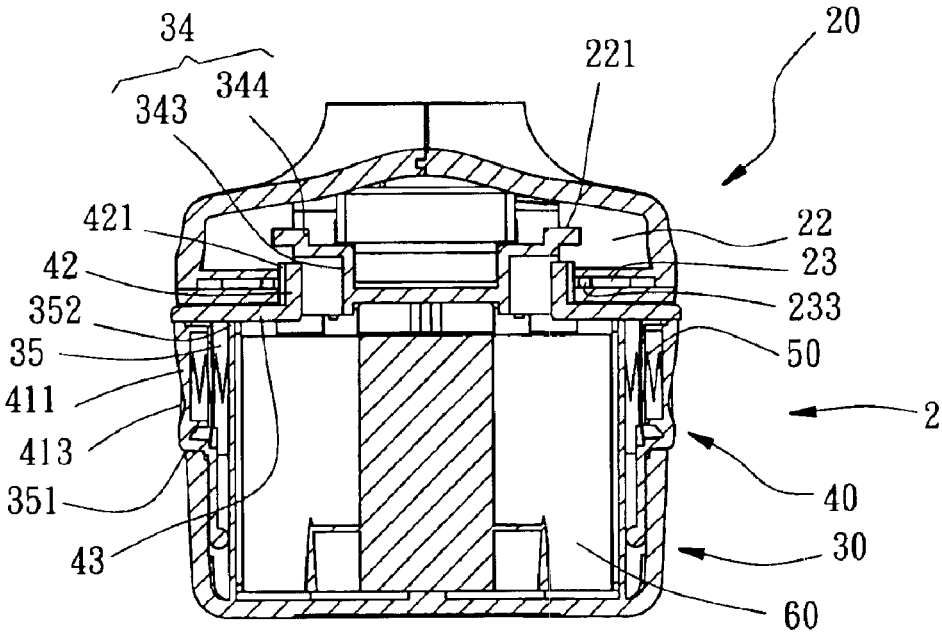
FIG. 4 is a sectional view taken from a line 4—4 indicated in FIG. 1.

Referring to FIG. 4 together with FIGS. 1–3, the two first ends 341 of the two conjunct rails 34 face the lateral opening 212 of the coupling member 20 to further enable the two rail portions 344 to be inserted through the two insertion holes 222 and into the two conjunct grooves 221. Push the housing 30 to enable the two rail portions 344 to completely slide into the two conjunct grooves 221. Meanwhile, the second guide surfaces 421 of the two locking portions 42 pass through the two curbs 23 to enable the two second guide surfaces 421 of the two locking portions 42 to be pushed respectively by the two first guide surfaces 233 of the two curbs 23 to further drive the two locking members 40 to move towards inside of the housing 30; after the two locking portions 42 of the two locking members 40 pass by the two curbs 23, the two rail portions 344 completely slide into the two conjunct grooves 221, and the two locking members 40 are respectively supported by the two springs 50 to return respectively to original positions and to respectively engage the two curbs 23, thereby avoiding disengagement of the battery pack 2 from the tool unit 1. Accordingly, the tool unit 1 and the battery pack 2 are coupled with each other.

When the user intends to remove the battery pack 2 from the tool unit 1, the user can press the two buttons 41 of the two locking members 40 by two fingers (ex. thumb and first finger, or thumb and middle finger) of one single hand to respectively drive the two locking portions 42 to disengage from the two curbs 23 and to simultaneously draw the battery pack 2 to enable the two rail portions 344 to slide out of the two conjunct grooves 221, thereby removing the battery pack 2 from the tool unit 1.

In conclusion, the electric power tool A constructed according to the first preferred embodiment of the present invention includes advantages as follows.

1. Because the conjunct grooves 221 and the conjunct rails 34 are small-sized, the tool unit 1 and the battery pack 2 are more effectively dimensionally reduced than the prior art to facilitate carrying and using the electric power tool A.
2. The locking portions 42 of the two locking members 40 are mounted at the lower sides of the rail portions 344 of the conjunct rails 34, such that the space under the rail portions 344 can be effectively utilized to effectively reduce the size of the electric power tool A.
3. While the conjunct grooves 221 and the conjunct rails 34 are interconnected, the coupling member 20 engages against the top cover 33 of the housing 30 at the bottom side thereof to enlarge the contact area between the tool unit 1 and the battery pack 2 and to enforce the connection therebetween to further effectively avoid shaking therebetween.
4. When the battery pack 2 is coupled with the tool unit 1, the weight of the battery pack 2 is supported by the conjunct groves 221 and the conjunct rails 34 rather than supported by the two locking portions 42 and the two curbs 23, such that the tool unit 1 and battery pack 2 are secured preferably tight.
5. To remove the battery pack 2 from the tool unit 1, the user has to simultaneously press the two buttons 41 of the two locking members 40. Accordingly, the disengagement of the battery pack 2 from the tool unit 1 caused by carelessly touching any of the two locking members 40 can be avoided while the user is operating the electric power tool A.

What is claimed is:

1. An electric power tool comprising:

a tool unit having a tool body and a coupling member connected to a bottom side of said tool body, said coupling member having inside a receiving chamber defining a bottom opening and a lateral opening respectively at a bottom side and a lateral side of said coupling member, said bottom and lateral openings being in communication with each other, said coupling member having two conjunct grooves respectively positioned at bilateral sides of said chamber, said two conjunct grooves being parallel to each other and defining two openings facing to each other, said two conjunct grooves respectively defining two insertion holes at the same side of said coupling member, said two insertion holes facing said lateral opening, said coupling member having two curbs positioned inside said chamber and respectively at lower sides of said two conjunct grooves, each of said two curbs defining a root end and a free end, said two free ends facing to each other, each of said two curbs having a guide surface extending from said free end towards said lateral opening and said root end; and a battery pack having a housing and two locking members, said housing having a battery compartment inside and a top cover on which two parallel conjunct rails and two slots are formed, each of said two conjunct rails having a root portion and a rail portion, said two rail portions respectively extending from top sides of said two root portions towards opposite directions, said two slots being in communication with said battery compartment, said housing having two cavities at two opposite sides thereof, each of said two cavities having a through hole in communication with said battery compartment, each of said two locking members having a button, a locking portion, and an arm portion interconnecting said button and said locking portion, said two locking members being respectively connected to said housing to enable said two buttons respectively to be positioned inside said two cavities, to enable said two arm portions to be inserted into said two through holes, and to enable said two locking portions to respectively pass through and protrude out of said top cover to be further positioned under said two rail portions of said two conjunct rails.

2. The electric power tool as defined in claim 1, wherein said coupling member of said tool unit comprising a pair of skeleton members positioned respectively at bilateral sides of said chamber, said two skeleton members extending from an end in proximity of said lateral opening towards the other end of said coupling member, said two conjunct grooves being respectively formed on said two skeleton-like members and parallel extending from an end in proximity of said lateral opening towards the other end of said coupling member, each of said two insertion holes of said two conjunct grooves being positioned at an end abutting said lateral opening.

3. The electric power tool as defined in claim 1, wherein said tool unit further comprises an electrical contact positioned inside said chamber; said battery pack comprises a power output contact disposed on said housing in corresponding position to said electrical contact.

4. The electric power tool as defined in claim 3, wherein said battery pack further comprises a set of battery cells fixedly mounted inside said battery compartment, an electrode of said battery cells being electrically connected with said power output contact.

5. The electric power tool as defined in claim 1, wherein said two cavities respectively define two openings at two lateral symmetrical sides of said housing; each of said buttons has a main body having an interior surface and an exterior surface; each of said two arm portions interconnects said interior surface of said main body and said locking portion; when said two locking members are connected to said housing, said two exterior surfaces of said two main bodies are exposed respectively outside said two openings of said two cavities.

6. The electric power tool as defined in claim 5, wherein said battery pack further comprises two springs positioned respectively inside said two cavities, each of said two springs contacting against a bottom side of said corresponding cavity and said interior surface of said main body of said corresponding button respectively at two ends.

* * * * *